US009567782B2

(12) United States Patent
Raatikainen

(10) Patent No.: US 9,567,782 B2
(45) Date of Patent: Feb. 14, 2017

(54) LOWER LOCK OF THE PASSIVE DOOR BLADE OF A DOUBLE DOOR

(75) Inventor: Juha Raatikainen, Kontiolahti (FI)

(73) Assignee: Abloy Oy, Joensuu (FI)

( * ) Notice: Subject to any disclaimer, the term of this patent is extended or adjusted under 35 U.S.C. 154(b) by 6 days.

(21) Appl. No.: 13/203,943

(22) PCT Filed: Mar. 23, 2010

(86) PCT No.: PCT/FI2010/050227
§ 371 (c)(1),
(2), (4) Date: Aug. 30, 2011

(87) PCT Pub. No.: WO2010/109069
PCT Pub. Date: Sep. 30, 2010

(65) Prior Publication Data

US 2011/0309641 A1 Dec. 22, 2011

(30) Foreign Application Priority Data

Mar. 27, 2009 (FI) ..... 20095327

(51) Int. Cl.
*E05C 1/12* (2006.01)
*E05C 7/06* (2006.01)
(Continued)

(52) U.S. Cl.
CPC ..... *E05C 7/06* (2013.01); *E05B 2015/041* (2013.01); *E05C 9/04* (2013.01); *Y10T 292/0994* (2015.04)

(58) Field of Classification Search
CPC .... E05B 65/1013; E05B 55/12; E05B 63/205; E05B 63/22; E05B 63/20; E05B 17/2034; E05B 85/22; E05B 59/00; E05C 1/04;E05C 1/00; E05C 17/48; E05C 19/028; E05C 7/06; E05C 17/08; E05C 17/085; E05C 9/04; E05C 1/12; E05C 1/16; Y10S 292/36
(Continued)

(56) References Cited

U.S. PATENT DOCUMENTS 1,338,713 A * 5/1920 Toney ..... E05C 7/06 292/226
2,034,570 A * 3/1936 Flavin ..... E05C 7/06 292/146
(Continued)

FOREIGN PATENT DOCUMENTS

FR 2 774 720 A1 8/1999

*Primary Examiner* — Kristina Fulton
*Assistant Examiner* — Faria Ahmad
(74) *Attorney, Agent, or Firm* — Muncy, Geissler, Olds & Lowe, P.C.

(57) ABSTRACT

The lock of the passive door blade of a double door according to the invention comprises a lock body (23), a latch (17) and a control wedge (18). The control wedge is arranged to linearly move to a position extended out from the lock and to a position retracted inside the lock. The lock additionally comprises a lever (20), a leading shaft (21) and a spring system (27). The lever (20) is rotatably attached (25) to the control wedge (18) by its first end and rotatably attached (24) to the leading shaft (21) by its second end. The leading shaft (21) is additionally rotatably attached (22) to the lock body (23) and the leading shaft comprises a control cam (26) being in connection with the latch (17). The lever (20) and the leading shaft (21) are arranged to transfer the force of the spring system (27) to the control wedge (18) so that the force parallel with the linear movement of the control wedge is at its largest in the extended position of the control wedge and at its smallest when the control wedge is in the retracted position inside the lock.

15 Claims, 3 Drawing Sheets

Figure 1:
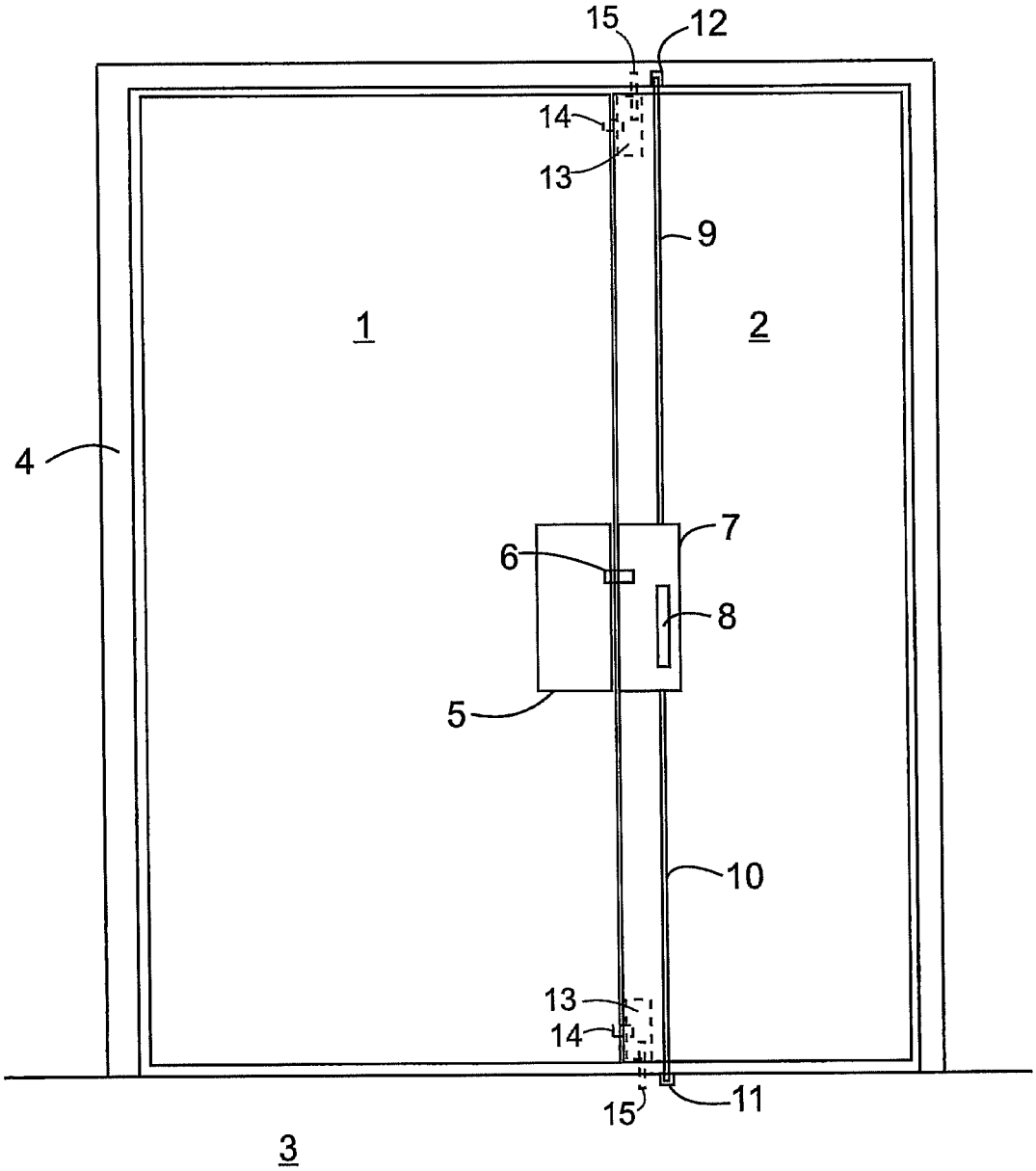

(51) Int. Cl.

| | |
|---|---|
| *E05C 1/00* | (2006.01) |
| *E05C 1/02* | (2006.01) |
| *E05C 1/06* | (2006.01) |
| *E05C 9/00* | (2006.01) |
| *E05C 9/10* | (2006.01) |
| *E05B 59/00* | (2006.01) |
| *E05B 63/14* | (2006.01) |
| *E05B 15/04* | (2006.01) |
| *E05C 9/04* | (2006.01) |

(58) Field of Classification Search
USPC ..... 292/137, 92, 93, 94, 173, DIG. 21, 2, 3,292/25, 26, 33, 40, 48, 34, 35, 177, 21, 332,292/333; 70/108–111
See application file for complete search history.

(56) References Cited

U.S. PATENT DOCUMENTS 2,079,895 A * 5/1937 Brooks ..... E05B 85/22 292/153
2,202,916 A * 6/1940 Mussa ..... E05C 7/06 292/177
2,406,459 A * 8/1946 Gibson ..... E05C 9/04 292/39
2,535,947 A * 12/1950 Newell ..... E05C 9/046 292/23
2,886,960 A * 5/1959 Willett ..... E05B 65/10 160/353
3,455,591 A * 7/1969 Powers ..... E05B 65/1046 292/335
3,578,369 A * 5/1971 Coopersmith ..... E05C 7/06 292/182
3,582,122 A * 6/1971 Foster ..... E05B 63/20 292/21
3,852,122 A * 12/1974 Aarflot et al. ..... 148/549
3,999,411 A * 12/1976 Kambic ..... E05B 55/00 292/165
4,005,886 A * 2/1977 Lirette ..... E05C 7/06 292/177
4,009,753 A * 3/1977 McGill ..... E21B 29/04 166/298
4,037,440 A * 7/1977 Shabtai ..... E05B 17/042 292/37
4,049,304 A * 9/1977 Imhoff ..... E05C 7/06 292/333
4,099,753 A * 7/1978 Gwozdz ..... E05B 65/104 292/1.5
4,445,717 A * 5/1984 Imhoff ..... E05B 17/0058 292/177
4,470,277 A * 9/1984 Uyeda ..... E05B 65/0075 292/34
4,611,840 A * 9/1986 Martin ..... E05C 7/06 292/177
4,643,005 A * 2/1987 Logas ..... E05C 9/026 292/20
4,677,834 A * 7/1987 Hicks ..... E05B 47/0002 292/144
4,685,709 A * 8/1987 Kambic ..... E05B 47/0012 292/201
4,796,931 A * 1/1989 Heid ..... E05B 65/1053 292/337
5,004,277 A * 4/1991 Campbell ..... E05C 1/065 292/166
5,005,881 A * 4/1991 Bailey ..... E05C 7/06 292/177
5,076,620 A * 12/1991 Campbell ..... E05C 1/065 292/138
5,083,448 A * 1/1992 Karkkainen ..... E05B 47/0012 292/144
5,177,988 A * 1/1993 Bushnell ..... E05B 47/0002 292/144
5,290,077 A * 3/1994 Fleming ..... E05B 65/087 292/341.11
5,373,716 A * 12/1994 MacNeil ..... E05C 9/026 292/165
5,524,941 A * 6/1996 Fleming ..... E05B 65/087 292/140
5,527,074 A * 6/1996 Yeh ..... 292/177
5,566,991 A * 10/1996 Young ..... E05B 47/0012 292/201
5,791,700 A * 8/1998 Biro ..... E05C 9/043 292/36
5,931,515 A * 8/1999 Stendal ..... E05B 15/10 292/139
6,120,071 A 9/2000 Picard et al.
6,282,929 B1 * 9/2001 Eller ..... E05C 9/02 292/32
6,324,876 B1 * 12/2001 Prevot ..... E05B 15/0053 292/34
6,389,855 B2 * 5/2002 Renz ..... E05B 63/143 292/335
6,409,231 B1 * 6/2002 Rusiana ..... B29C 65/5042 156/330
6,820,905 B1 * 11/2004 Haeck ..... E05B 65/1013 292/223
6,883,837 B1 * 4/2005 Lin ..... E05C 7/06 292/33
7,404,306 B2 * 7/2008 Walls ..... E05C 9/20 292/139
7,410,195 B1 * 8/2008 Martin ..... E05B 47/0009 292/163
7,513,540 B2 * 4/2009 Hagemeyer ..... E05B 15/0205 292/156
7,513,542 B2 * 4/2009 Schumm ..... E05C 17/446 292/163
7,526,933 B2 * 5/2009 Meekma ..... E05B 63/0056 292/39
7,712,799 B2 * 5/2010 Peng ..... E05B 65/1013 292/137
7,926,315 B2 * 4/2011 Poletti ..... E05B 59/00 292/336.3
7,946,080 B2 * 5/2011 Ellerton ..... E05C 7/04 292/32
8,061,166 B2 * 11/2011 Tsai ..... E05C 9/10 292/35
8,191,937 B2 * 6/2012 Lin ..... E05C 7/06 292/137
8,556,306 B1 * 10/2013 Lin ..... E05C 7/045 292/157
8,562,032 B1 * 10/2013 Lin ..... 292/166
8,702,132 B2 * 4/2014 Tien ..... E05B 65/104 292/219
8,899,635 B2 * 12/2014 Nakanishi ..... E05B 63/0056 292/194
2003/0080567 A1 * 5/2003 Peacock ..... E05C 9/043 292/3
2010/0259052 A1 * 10/2010 Lin ..... E05C 7/06 292/56
2011/0198869 A1 * 8/2011 Lu ..... E05B 63/12 292/195
2013/0093195 A1 * 4/2013 Tien ..... E05B 65/1006 292/93
2014/0217750 A1 * 8/2014 Lin ..... E05C 7/045 292/156
2014/0265355 A1 * 9/2014 Tien ..... E05B 65/104 292/21

* cited by examiner

LOWER LOCK OF THE PASSIVE DOOR BLADE OF A DOUBLE DOOR

FIELD OF INVENTION

The present invention relates to a lock of the passive door blade of a double door. The invention especially relates to a lower lock of the passive door blade.

BACKGROUND ART

FIG. 1 illustrates two known ways of locking the passive door of a double door. The double door consists of an active door blade 1 and a passive door blade 2. The active door blade and the passive door blade are also called the active door and the passive door. The active door blade is the door for normal usage, used when the doorway is passed through when not carrying larger loads. In case larger items must be transported through the doorway, such as during moving, opening the active door blade does not necessarily form a large enough opening. In such case the passive door blade is opened as well. Usually the passive door blade is locked to the jamb structure 4 of the doorway and the floor level 3.

The active door blade 1 and the passive door blade 2 are rotatably attached to the jamb structure 4 of the doorway by means of hinges. Usually the active door blade 1 comprises a lock 5 comprising a bolt 6. When the active door 1 is locked, the bolt 6 is partially inside the striker lock body 7, thus locking the active door to the passive door. The striker lock body is also called a striker lock and vice versa, because in practice the body comprises the lock functions. Because the passive door 2 is locked to the jamb structure 4 of the doorway and the floor level 3, the passive door cannot rotate and neither can the active door locked to the passive door. It can be said that in normal use the passive door is a part of the jamb structure of the doorway 4. The locking of the active door 1 is released normally and the door is opened normally.

The striker lock body 7 is combined with pull bars 9, 10 installed in the passive door 2 and locking the passive door to the jamb structure of the doorway and the floor. Recesses 12, 11, into which the ends of the striker bars are located when the passive door is locked, are arranged in the jamb structure 4 and the floor level 3. A release means 8 is arranged in the striker lock body for pulling the pull bars towards the inside of the passive door so that the ends of the pull bars move away from the recesses 11, 12 of the frame structure and the floor level. The name of the pull bars is derived from this action. When the pull bars are pulled inside the passive door, the passive door can be opened, i.e. rotated. A typical release means 8 comprises a hand-turnable lever. In some known solutions the release means 8 is not located in connection with the striker lock body of the passive door but instead it is formed as a separate unit being in connection with the pull bars. The pull bars can also be moved back to the protruding position away from the inside of the passive door by using the release means 8, whereby the passive door can be locked back to the jamb structure and the floor level.

Another way of locking the passive door is by using separate locks in the upper edge and/or lower edge of the passive door blade. FIG. 1 illustrates an embodiment in which both the upper edge and the lower edge of the passive door blade comprise a lock 13. The lock comprises a latch 15 that is in protruded position when the door is locked. The latch of the upper lock 15 locks the passive door to the frame 4 while the latch 15 of the lower lock locks the door to floor level 3. The locking of the doors is released when the active door blade is opened, whereby the control wedge 14 of the lock 13 can move out. The protrusion of the control wedge directs the latch 15 to the inside of the lock, whereby the passive door can be opened. The locking is effected when the active door is turned against the passive door, whereby the control wedge is depressed to inside the lock and simultaneously directs the latch 15 from the lock.

The problem with the upper and lower lock is that the control wedge 14 resists closing and opening the active door. The lock 13 has a spring/spring system pressing the control wedge out from the lock. The control wedge then presses the active door. This reduces convenient usability of the active door. Further, if the active door is combined with door automatics, the lock 13 can also resist the operation of the door opening/closing apparatus.

There also are solutions in which the ends 9, 10 of the pull bars are in connection with the upper and lower lock of the passive door. Thereby the bolts of the upper and lower locks lock the passive door to the jamb structure and the floor level instead of the ends of the pull bars. The operation of the upper and lower locks can be controlled by means of the release means 8 via the pull bars 9, 10.

BRIEF DESCRIPTION OF THE INVENTION

The aim of the invention is to provide a lock for the passive door blade producing minimal disadvantages for the use of the active door. The aim is achieved as described in the independent claim. The dependent claims describe the various embodiments of the invention.

The lock 16 of the passive door blade comprises a lock body 23, a latch 17 and a control wedge 18. The control wedge is arranged to linearly move to a position extended away from the lock and a position retracted into the lock. The lock additionally comprises a lever 20, a leading shaft 21 and a spring system 27. The lever 20 is rotatably fastened 25 at its first end to a control wedge 18 and rotatably fastened 24 to the leading shaft 21 at its other end. The leading shaft 21 is also rotatably attached 22 to the lock body 23 and the leading shaft comprises a control cam 26 being in connection with the latch 17. The spring system 27 is arranged to rotate the leading shaft towards a position in which the control cam 26 keeps the latch 17 inside the lock and in which the control wedge 18 is in the extended position.

The lever 20 and the leading shaft 21 are arranged to transfer the force of the spring system 27 to the control wedge 18 so that the force parallel with the linear movement of the control wedge is at its largest in the extended position of the control wedge and at its smallest when the control wedge is in the position retracted inside the lock.

LIST OF FIGURES

Figure 3:
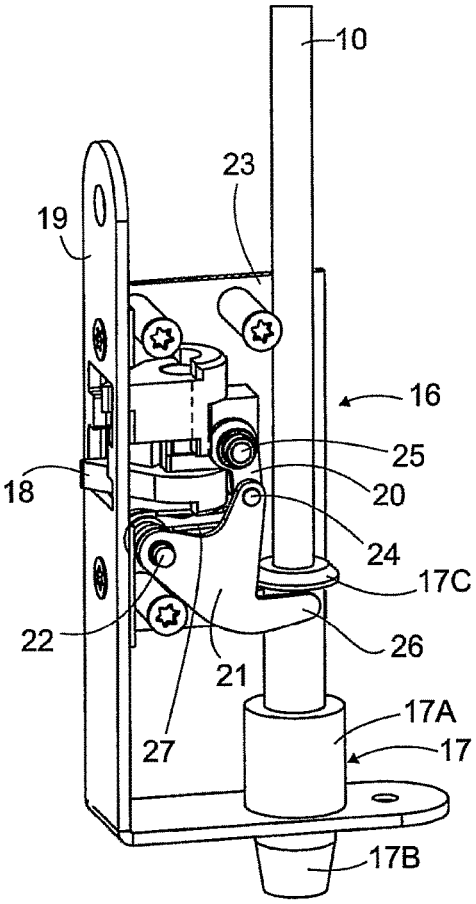
Figure 2:
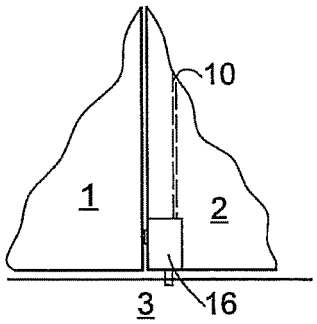
Figure 4:
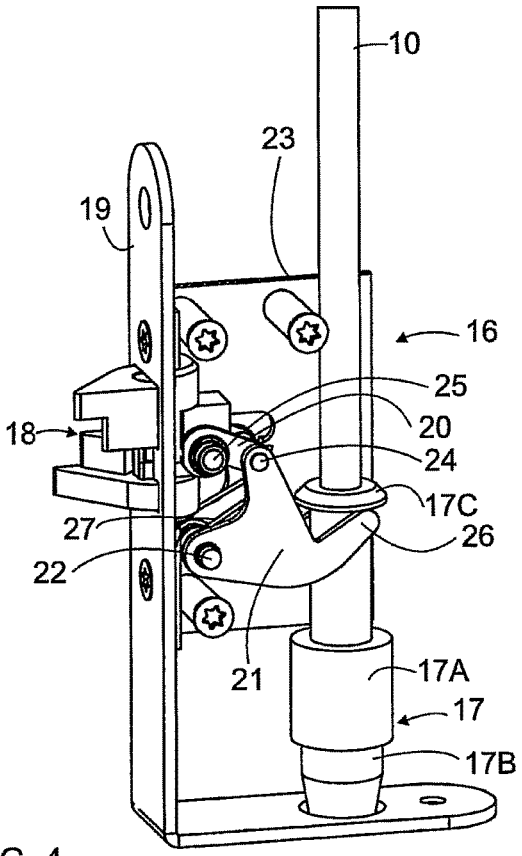
Figure 5:
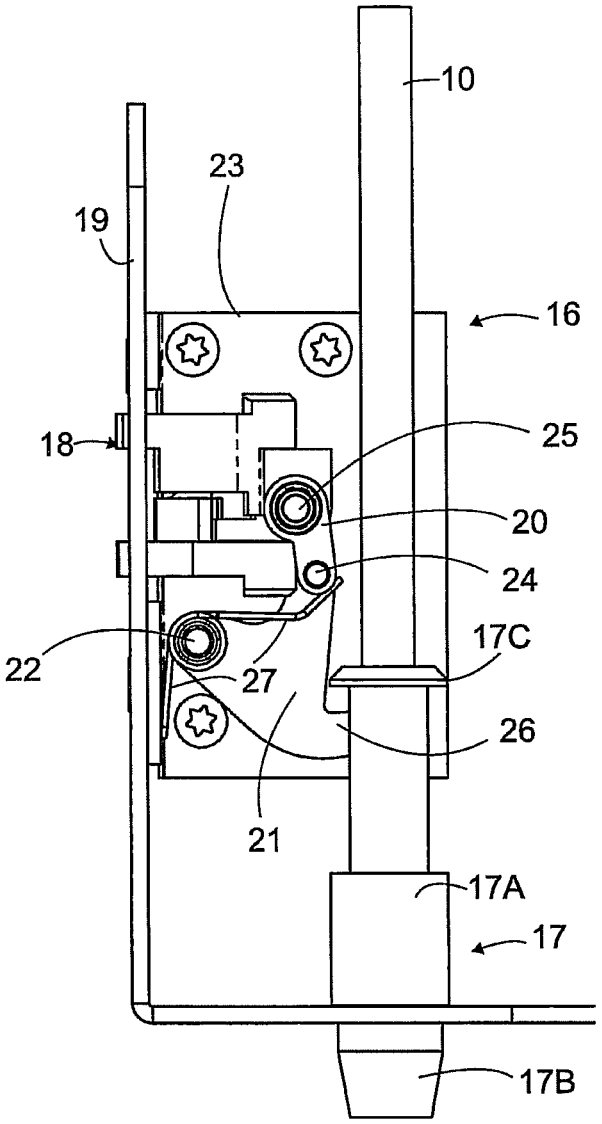

In the following the invention is described in more detail by reference to the appended figures, in which FIG. 1 shows examples of known ways to lock a passive door, FIG. 2 shows an example of a lock according to the invention, FIG. 3 shows an example of a lock according to the invention in locked state, FIG. 4 shows an example of a lock according to the invention in open state, FIG. 5 shows an example of a lock according to the invention seen from the side.

DESCRIPTION

FIG. 2 shows an example of the lock according to the invention. The lock 16 according to the invention is mainly designed to be installed in the lower edge of a passive door 2 as shown in FIG. 2. The latch of the lock is against the floor level 3 and the control wedge is against the active door 1 when the blades of the double door are against each other. A connection point can optionally be included in the lock by means of which the pull bar 10 can be connected to the latch. The connection point is e.g. a hole provided with an internal thread in the latch of the lock, to which the pull bar can be threaded. The end of the pull bar is often provided with an external thread. The pull bar allows controlling the lock manually as well by means of a control means, such as a control lever, operationally connected to one end of the pull bar.

FIG. 3 shows an example of the lock 16 according to the invention when the lock is in locked state. The lock comprises a lock body 23, a latch 17 and a control wedge 18. The control wedge is arranged to linearly move to a position extended away from the lock and to a position retracted into the lock. Preferably the control wedge is a so-called light latch, as shown in FIG. 3. the control wedge can also be a normal slanted latch.

The lock additionally comprises a lever 20, a leading shaft 21 and a spring system 27. The lever 20 is rotatably fastened 25 at its first end to the control wedge 18 and rotatably fastened 24 by its second end to the leading shaft 21. The rotatable attachment can be carried out e.g. by means of an axle stub. The leading shaft 21 is also rotatably fastened 22 to the lock body 23. The leading shaft also comprises a control cam 26 being in loose contact with the latch 17. Loose contact means that when the latch is out, the control cam allows upward movement of the latch, i.e. the connection between the control cam and the latch is removable. Mainly the connection of the latch and the control cam is maintained in the various usage situations of the lock. In other words, the physical contact between the latch and the control cam is the main contact.

The spring system 27 is arranged to rotate the leading shaft towards the position in which the control cam 26 keeps the latch 17 inside the lock and the control wedge 18 is in the extended position. FIG. 4 shows this position.

Thus the leading shaft is arranged to rotate about the lock body 23 at the attachment point 22 of the lock body and the leading shaft. The rotation of the leading shaft also controls the control wedge 18 and the latch 17. The lever 20 and the leading shaft 21 are arranged to transfer the force of the spring system 27 to the control wedge 18 so that the force parallel with the linear movement of the control wedge is at its largest in the extended position of the control wedge and at its smallest in the position in which the control wedge is retracted into the lock.

In FIG. 3 the control wedge 18 is inside, i.e. the force in the direction of the movement of the wedge is at its smallest. When the active door is open, the control wedge can move out from the lock body pushed by the spring system 27. The force of the spring system rotates the leading shaft 21 which in turn transfers the force of the spring system to the lever 20. The lever transmits the force to the control wedge. When the control wedge thus moves, the mutual position of the leading shaft 21 and the lever 20 changes in relation to each other, having an effect on the force parallel with the movement of the control wedge 18.

In FIG. 4 the control wedge 18 is outside, i.e. the force in the direction of the movement of the wedge is at its largest. When the active door is rotated against the passive door, the active door pushes the control wedge inside the lock. The force resisting the movement of the active door is initially at its largest, but it is reduced when the control wedge is pushed towards the lock. This also makes it easier for the active door to close. It can be seen that this feature also makes it easier to open the door.

In case automatic operation is combined with the active door for opening and/or closing the door the lock according to the invention also makes the operation of the used door automatic apparatus easier. Thus the automatics apparatus does not need so much operation force as when using known apparatuses. The automatic apparatus can also be dimensioned for a smaller power.

FIGS. 3 and 4 show a lock designed for the lower edge of the passive door. As can be seen in FIG. 3, the latch 17 of the lock can move between the extended and retracted positions when the control wedge 18 is in the position retracted inside the lock. Thus the latch 17 can freely move from the extended position to the position retracted inside. Gravity tends to keep the latch 17 in the extended position. The advantage of such free movement is that the lower latch of the passive door does not hinder closing the active door if the opening of the floor level for some reason isn't aligned with the latch 17 or if the opening in question contains debris partially preventing the extension of the latch.

FIGS. 3 and 4 also show that the latch 17 comprises a control part 17C being mainly in connection with the control cam 26. The embodiment of the control part in the figures is a protrusion but it can also be e.g. an indentation into which the control cam 26 is positioned. Extension movement of the part of the latch 17 being extended from the lock 16, i.e. the extension part 17B, can be limited by means of the embodiment shown in the figures. The latch 17 of this embodiment comprises an protrusion 17A limiting the extension of the latch outside via the opening in the front plate of the lock. The latch of the embodiment of the figures also comprises a connection point by means of which the pull bar 10 can be connected to the latch. Thus there is a number of different embodiments for carrying out the latch and the latch shown in the figures illustrates a number of optional features.

The spring system 27 of the embodiment of the figures is a torsion spring system arranged in connection with the attachment point 22 of the leading shaft 21 to the lock body so that the first free end of the spring system 27 is supported by the lock body 23 and the other free end of the spring system is supported by the attachment point 24 of the leading shaft 21 and the lever 20. FIG. 5 shows the spring system from the side. It is naturally also possible to carry out the spring system by other means for rotating the leading shaft 21.

It can be seen in the figures that the front plate 19 of the lock is L-shaped. The first edge of the front plate comprises a hole for the control wedge 18 and the other edge comprises a hole for the bolt 17.

Should it be desired to use to the lock according to the invention in the upper edge of the passive door so that the latch can be depressed inside the lock body if the hole in the jamb of the door is not aligned or it has been plugged somehow, the lock according to the invention must be provided with a spring or the like means for lifting the latch up.

In light of the above examples it is obvious that the embodiment according to the invention can be realized in a number of ways. It is obvious that the invention is not limited to the examples mentioned here, but that the invention can be realized by a number of different embodiments within the appended claims.

The invention claimed is:

1. A lock of a passive door blade of a double door, comprising a lock body, a latch and a control wedge, the control wedge being arranged to linearly move to a position extended out from the lock and to a position retracted into the lock, wherein the lock also comprises a lever, a leading shaft and a spring system, the lever being rotatably attached by its first end to the control wedge directly through an axle, and rotatably and directly attached by its other end to the leading shaft, the leading shaft additionally being rotatably and directly attached to the lock body, the leading shaft having a control cam, the control cam removably receives the latch, the spring system being arranged to rotate the leading shaft towards the position in which the control cam keeps directly the latch inside the lock and in which the control wedge is in the extended position, the lever and the leading shaft being arranged to transfer force of the spring system to the control wedge so that the transferred force, which is parallel with the linear movement of the control wedge, is at its largest in the extended position of the control wedge and at its smallest when the control wedge is in the position retracted inside the lock, wherein the lever and the leading shaft are separate parts.

2. The lock according to claim 1, wherein the latch of the lock can move between the extended and retracted positions when the control wedge is in the retracted position inside the lock.

3. The lock according to claim 2, wherein the latch comprises a control part being mainly in connection with the control cam.

4. The lock according to claim 3, wherein the latch comprises a pushing part being the part of the latch that is pushed out of the lock.

5. The lock according to claim 4, wherein the latch comprises a protrusion limiting the extension of the latch.

6. The lock according to claim 1, wherein the latch comprises a connection point by means of which a pull bar is connectable to the latch.

7. The lock according to claim 1, wherein the spring system is a spiral spring system arranged in connection with the attachment point of the leading shaft to the lock body so that the a free end of the spring system is supported by the lock body and a second free end of the spring system is supported by the attachment point of the leading shaft and the lever.

8. The lock according to claim 1, wherein the lock comprises a front plate being L-shaped, the front plate comprising in its first edge an opening for the control wedge and in the second edge an opening for the bolt.

9. The lock according to claim 1, wherein the lock is provided with a spring pushing the latch out from the lock.

10. The lock according to claim 1, wherein the control cam removably holds the latch.

11. The lock according to claim 1, wherein the control cam is an integral part of the leading shaft.

12. The lock according to claim 1, wherein the leading shaft is rotatable about the lock body at the attachment of the lock body and the leading shaft.

13. The lock according to claim 1, wherein the latch has a control part that engages the control cam.

14. The lock according to claim 13, wherein the control part is a protrusion.

15. A lock of a passive door blade of a double door, comprising:

a lock body;

a latch;

a control wedge arranged to linearly move to a position extended out from the lock and to a position retracted into the lock;

a leading shaft rotatably and directly attached to the lock body, the leading shaft comprising a control cam that removably receives the latch;

a lever rotatably attached by a first end to the control wedge directly through an axle and rotatably and directly attached by a second end to the leading shaft; and a spring system arranged to rotate the leading shaft towards a position in which the control cam keeps directly the latch inside the lock and in which the control wedge is in the extended position, wherein the lever and the leading shaft are separate parts.

* * * * *